US005832355A

United States Patent [19]

Köfferlein

[11] Patent Number: 5,832,355

[45] Date of Patent: Nov. 3, 1998

[54] CLEANING MECHANISM FOR THE PHOTOCONDUCTIVE DRUM OF A PRINTER OR COPIER DEVICE

[75] Inventor: Rainer Köfferlein, München, Germany

[73] Assignee: Siemens Nixdorf Informationssysteme Aktiengesellschaft, Paderborn, Germany

[21] Appl. No.: 952,041

[22] PCT Filed: May 2, 1996

[86] PCT No.: PCT/DE96/00759

§ 371 Date: Nov. 3, 1997

§ 102(e) Date: Nov. 3, 1997

[87] PCT Pub. No.: WO96/35151

PCT Pub. Date: Nov. 7, 1996

[30] Foreign Application Priority Data

May 3, 1995 [DE] Germany ..... 195 16 210.2

[51] Int. Cl.[6] ..... G03G 21/00

[52] U.S. Cl. ..... 399/349; 399/350; 15/256.51

[58] Field of Search ..... 399/349, 347, 399/343, 350, 345, 351; 15/256.51, 256.52

[56] References Cited

U.S. PATENT DOCUMENTS

| | | | |
|---|---|---|---|
| 3,879,124 | 4/1975 | Eppe et al. . | |
| 4,984,028 | 1/1991 | Tonomoto | 399/349 |
| 4,989,047 | 1/1991 | Jugle et al. | 399/349 |
| 5,031,000 | 7/1991 | Pozniakas et al. | 399/349 |
| 5,066,983 | 11/1991 | Tonomoto | 399/349 |
| 5,138,395 | 8/1992 | Lindblad et al. | 399/346 |
| 5,339,149 | 8/1994 | Lindblad et al. | 399/351 |
| 5,442,422 | 8/1995 | Owens, Jr. et al. | 399/103 |

FOREIGN PATENT DOCUMENTS

| | | |
|---|---|---|
| 0 320 812 | 6/1989 | European Pat. Off. . |
| 0 432 453 | 6/1991 | European Pat. Off. . |
| 0 464 032 | 1/1992 | European Pat. Off. . |

OTHER PUBLICATIONS

Japanese Abstract, vol. 18, No. 405, JP6118858, Apr. 28, 1994.

Japanese Abstract, vol. 17, No. 658, JP5216378, Aug. 27, 1993.

Japanese Abstract, vol. 11, No. 216, JP62034182, Feb. 14, 1987.

Japanese Abstract, vol. 17, No. 485, JP5–119686, May 18, 1993.

Japanese Abstract, vol. 17, No. 416, JP5–80676, Apr. 2, 1993.

Japanese Abstract, vol. 17, No. 621, JP5–197317, Aug. 6, 1993.

Japanese Abstract, vol. 18, No. 81, JP5–289595, Nov. 5, 1993.

Japanese Abstract, vol. 18, No. 522, JP6–180543, Jun. 28, 1994.

*Primary Examiner*—Matthew S. Smith
*Attorney, Agent, or Firm*—Hill & Simpson

[57] ABSTRACT

A printer or copier has a photoconductive drum which is to be cleaned of residual toner after printing by a brush as a principal cleaner and by a stripper element of an abrasive-resistant film as an auxiliary cleaner. The stripper element of plastic film presses against the photoconductive drum at an angle to remove substances adhering to the drum. A pivot mounting may be provided for the stripper and a transverse moving device for moving the stripper may also be provided.

7 Claims, 1 Drawing Sheet

CLEANING MECHANISM FOR THE PHOTOCONDUCTIVE DRUM OF A PRINTER OR COPIER DEVICE

BACKGROUND OF THE INVENTION

FIELD OF THE INVENTION

The present invention is directed to a cleaning mechanism for the photoconductive drum of a printer or copier device.

For cleaning the photoconductive drum of a printer or copier device of adhering toner dust after the transfer printing process, it is standard practice to utilize cleaning stations that suction the remaining toner dust from the photoconductive drum with the assistance of a rotating brush and with underpressure suction. Given simply constructed laser printers for low printing speeds, stripper blades are used instead of the rotating cleaning brushes (see, for example the European Patent Document EP-B1 0 464 032). Motor-driven cleaning fleece can be utilized when an especially good cleaning is required.

All of these cleaning means serve the purpose of removing residual toner from the surface of the photoconductive drum.

Users of high-performance printers are employing recycled paper to an ever-increasing extent. The raw material for the manufacture of recycled paper also contains sticky constituents that cannot be completely removed in the manufacturing process. During printing, the sticky substances contained in the recycled paper can remain adhering to the photoconductive drum. Toner particles or larger particles of the sticky substances that deteriorate the transfer printing process can collect thereat. Lighter sections, i.e. light spots in the print format are produced as a consequence. For eliminating this malfunction, the photoconductive drum must be removed from the printer and cleaned. In addition to the considerable outlay required for such removal, there is the risk that the photoconductive drum will be damaged, this significantly shortening its average useful life.

This problem did not hitherto arise in printer or copier devices which use a cleaning fleece since the fleece eliminates the sticky spots and the adhering particles during the cleaning process. It is thereby disadvantageous that fine striations that considerably deteriorate the printing quality arise in the photoconductive layer due to fleece cleaning.

Cleaning brushes with denser and thicker fibers can in fact improve the cleaning of the drum surface but do not remove the sticky residues.

In printers that employ a stripper element for the photoconductive drum instead of the cleaning brush, these in fact largely strip the contamination off; such stripper elements are only conditionally employable or are completely out of the question for reasons of wear at high printing speeds given employment of high-grade toner material, for example, a polyester based toner and giver the use of inorganic photoconductive material.

European Patent Document EP-A-0432 453 discloses a cleaning mechanism for the photoconductor of an electrophotographic device having a brush cleaning station and a stripper element with a stripper edge of polyurethane following this station and lying against a photoconductor band opposite the running direction. The stripper element is arranged in a clamp mechanism of a mechanism that can be swivelled in and out. The stripper element lies on the photoconductor band with a seating force of 0.5–0.8N per 100 mm of edge length, namely in a seating angle between 0 and 9 angular degrees.

U.S. Pat. No. 3,879,124, further, discloses a cleaning mechanism for the photoconductor of an electrophotographic device wherein first a brush and then a plastic film arranged opposite the running direction of the photoconductive drum act on the photoconductor. The plastic film is of polyester and is of a thickness of 0.25 mm.

SUMMARY OF THE INVENTION

An object of the invention is to provide low-wear and functionally dependable cleaning mechanism for the photoconductive drum of a printer or copier device that is suitable for cleaning the photoconductive drum of adhering toner dust as well as for removing adhering glue residues without thereby damaging the photoconductive drum.

This and other objects and advantages of the invention are provided by a cleaning mechanism for cleaning a photoconductive drum of a printer or copier device having a brush cleaning station as a principal cleaning means, and an auxiliary cleaning means following the brush cleaning station in the running direction of the photoconductive drum and having a stripper element composed of an abrasion-resistant plastic film comprising a stripper edge that presses elastically against the photoconductive drum opposite the running direction thereof, the stripper element being of a thickness of 0.05 to 0.2 mm and lying against the photoconductor with a seating force of 0.1 through 1N per 100 mm and being positioned at an angle a between the photoconductive drum surface and the film that is less than 25 angular degrees, and the plastic film being of a plastic material with an edge tearing strength according to DIN 40634 that is greater than 100N and that is free of substances that can react with the toner being employed and/or that deteriorate the photoconductive properties of the photoconductive drum.

Advantages of the invention are provided by using polyethyleneterephthalate as the film material. Alternately, the film material may be a material from the substance groups of polyamides or polyimides or polyurethane. Further advantages are provided by a mechanism that pivots the stripper element against and away from the photoconductive drum as needed. Additionally, a mechanism that moves the stripper element transversely relative to the running direction of the photoconductive drum may be provided to reduce wear. In one embodiment, a mount that interchangeably accepts the stripper element is included. A clamp may be provided as the mount.

Given the inventive cleaning mechanism, a thin film cleans the photoconductive drum of adhering glue residues, the thin film being arranged following the cleaning brush and the discharge lamp as viewed in the moving direction of the photoconductive drum. The cleaning film is pressed against the photoconductive drum opposite the running direction so that it lies relatively flat against it. The front edge of the film which is at an acute angle scrapes the particles adhering to the photoconductive layer, especially those that, due to their size, would disrupt the transfer printing operation and, thus, the print format. The pressing powers of the film on the drum is relatively slight due to the selected arrangement, so that the wear of the film as well as the effects on the photoconductive drum are very slight. Since the principal purpose of the film is not cleaning the photoconductive drum of toner—the cleaning brush already takes care of this—but only the cleaning of occasionally adhering, larger particles, a low pressing power suffices. Moreover, no specific additives in the toner are required, as is needed if stripper elements are used instead of cleaning brushes.

Materials that, on the one hand, are wear-resistant and, on the other hand, are free of substances that can react with the toner or that deteriorate the properties of the photoconductor are especially suitable as the material for the cleaning films. The seating force should lie between 0.1 and 1 N per 100 mm. The angle between the film and the photoconductor layer should amount to less than 25°. A film of polyethyleneterephthalate (polyester) having a thickness of 0.05 to 0.2 mm is especially advantageous. Other plastic materials, for example from the substance groups of polyamides, polyimides and polyurethane, can be employed insofar as they meet said demands.

It is fundamentally adequate for the required cleaning function when the film is only intermittently pressed against the photoconductor layer. The service life of the film can be significantly enhanced and the influence on the photoconductor layer can be minimized by a mechanism with which the film can be pivoted in and out as needed.

A transverse movement of the film relative to the running direction of the photoconductive drum is also suitable for distributing topical wear effects on the film or the photoconductor layer onto larger areas.

It is also beneficial to fashion the film so that it is interchangeable. To this end, the film can be interchangeably arranged in a clamp means.

BRIEF DESCRIPTION OF THE DRAWINGS

Embodiments of the invention are shown in the drawings are described in greater detail below by way of example.

DETAILED DESCRIPTION OF THE PREFERRED EMBODIMENTS

Figure 1:
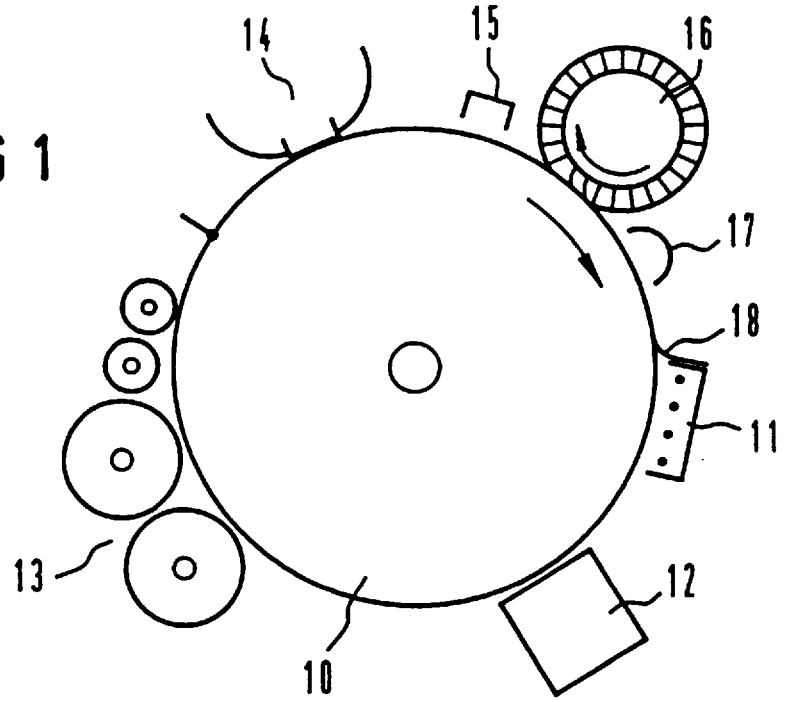
FIG. 1 is a schematic side sectional view of the units for the electrophotographic process arranged around the photoconductive drum.

An electrophotographic printer device for printing continuous form papers, which is only schematically shown here, contains a photoconductive drum 10 as an intermediate carrier with an inorganic Se photoconductor arranged thereon. The various units required for the electrophotographic process are grouped around the photoconductive drum 10. These are composed of a charging corotron 11, an illumination means 12 in the form of an LED camera, a developer station 13, a transfer printing station 14, a corotron 15, a cleaning brush 16 rotating in the opposite direction at the contact face with the photoconductive drum 10 and having an appertaining extraction means (not shown here), a discharge lamp 17 and a stripper element 18 in the form of a cleaning film secured to the charging corotron 11. The moving direction of the photoconductive drum 10 and the cleaning brush 16 is thereby identified by arrows. In the electrophotographic process, the photoconductive drum 10 is thereby uniformly charged with the assistance of the charging corotron 11 and is then discharged in a character-dependent fashion via the illumination means 12. The charge image that is generated in this way is then inked with having a styrolacrylate based toner or polyester based toner via the developer station 13, and the toner image generated in this way is transferred onto continuous form paper in the transfer printing station 14. Subsequently, an additional charge is applied on the drum 10 via the corotron 15 in order to loosen the electrostatic bond of the non-transferred toner particles at the surface of the photoconductive drum.

The removal of the residual toner particles then ensues via the rotating cleaning brush 16, which acts as a principal cleaning means. Subsequently, the entire photoconductive surface is discharged with the assistance of the discharge lamp 17. Larger particles or sticky substances adhering to the surface of the photoconductive drum are then stripped off with the assistance of the cleaning film 18, and the electrophotographic process begins anew.

Figure 2:
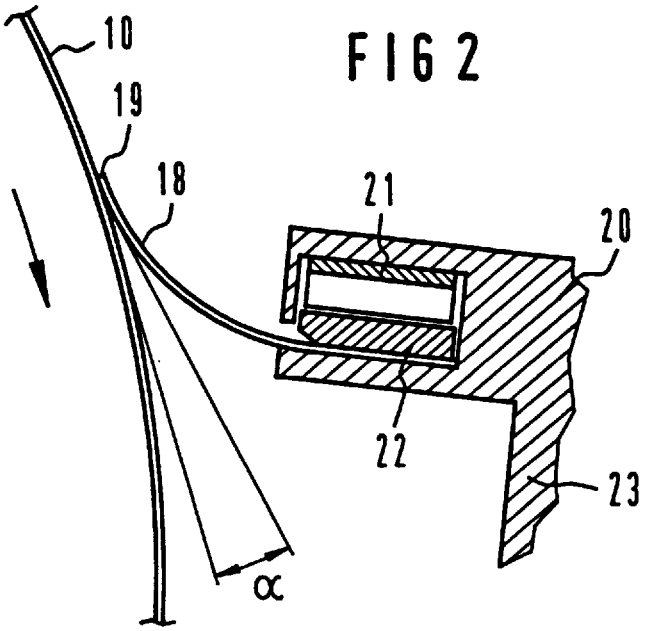
FIG. 2 is an enlarged sectional view of a stripper elements fashioned as a cleaning film, this being interchangeably arranged in a clamp means.

As shown in FIG. 2, the stripper means is composed of a thin plastic film of polyethyleneterephthalate (polyester) having a thickness of 0.05 to 0.2 mm with an acutely-angled stripper edge 19 that is arranged opposite the running direction of the photoconductive drum 10 such that the angle $\alpha$ between the film 18 and the surface of the photoconductive drum 10 amounts to less than 25 angular degrees. The cleaning film 18 is pressed against the photoconductive drum 10 with a seating force on the order of magnitude between 0.1 and 1N per 100 mm. The material employed for the film is wear-resistant corresponding to an edge tearing strength according to DIN 40634 that is greater than 100N.

So that the cleaning film 18 can be easily replaced, it is secured in a clamp means at one side. This is composed of a leaf spring 21 with appertaining clamp strip 22 arranged within a mount 20.

Given the illustrated exemplary embodiment, the mount is arranged at the charging corotron housing 23 of the charging corotron 11. The charging corotron 11 is fashioned as an insert that can be removed from the device in a simple way. This enables the film to be easily replaced after it has been used for a defined running performance.

Since it is fundamentally adequate for the film 18 to be only intermittently pressed against the photoconductive drum 10 depending on the operating condition of the printer device, the holding mechanism for the film can be pivotably fashioned. The fashioning of such a pivot mechanism is at the command of a person skilled in the art.

Further, a movement in, for example, the form of an oscillating movement of the film 18 transversely relative to the running direction of the photoconductive drum 10 is suitable for distributing the topical wear effects at the film 18 or photoconductor layer on the photoconductive drum 10 onto larger areas. The fashioning of a mechanism for oscillating movement of a stripper element is disclosed in the European Patent Document EP-B1 0 464 032.

In the described exemplary embodiment, polyester is employed as material for the cleaning film 18. Other plastic materials, for example from the substance groups of polyamides, polyimides and polyurethane, can also be employed insofar as they exhibit the required resistance to wear and are free of substances that react with the styrolacrylate based toner or polyester based toner that is employed or that deteriorate the properties of the inorganic photoconductor.

Although other modifications and changes may be suggested by those skilled in the art, it is the intention of the inventor to embody within the patent warranted hereon all changes and modifications as reasonably and properly come within the scope of his contribution to the art.

I claim:

1. A cleaning mechanism for cleaning a photoconductive drum of a printer or copier device of toner, comprising:

a brush cleaning station as a principal cleaning means, and an auxiliary cleaner following the brush cleaning station in a running direction of the photoconductive drum and having a stripper element including an abrasion-resistant plastic film with a stripper edge that presses elastically against the photoconductive drum opposite the running direction thereof, said abrasion-resistant plastic film is of a thickness of 0.05 to 0.2 mm and presses against the photoconductive drum with a seating force of 0.1 through 1N per 100 mm and at an angle $\alpha$ between a surface of said photoconductive drum and said abrasion-resistant plastic film that is less than 25 angular degrees, and said abrasion-resistant plastic film is of a plastic material with an edge tearing strength according to DIN 40634 that is greater than 100N and that is free of substances that can react with the toner and that is free of substances that deteriorate photoconductive properties of the photoconductive drum.

2. A cleaning mechanism according to claim 1, wherein said abrasion-resistant plastic film is polyethyleneterephthalate.

3. A cleaning mechanism according to claim 1, wherein said abrasion-resistant plastic film is of a material selected from the group consisting of:

polyamides and polyimides and polyurethane.

4. A cleaning mechanism according to claim 1, further comprising:

a mechanism that pivots the stripper element against and away from the photoconductive drum as needed.

5. A cleaning mechanism according to claim 1, further comprising:

a mechanism that moves the stripper element transversely relative to the running direction of the photoconductive drum.

6. A cleaning mechanism according to claim 1, further comprising:

a mount that interchangeably accepts the stripper element.

7. A cleaning mechanism according to claim 6, wherein said mount is a clamp.

* * * * *